United States Patent [19]

Granger

[11] Patent Number: 4,770,387

[45] Date of Patent: Sep. 13, 1988

[54] VARIABLE RAM SEAL FOR BLOWOUT PREVENTERS

[75] Inventor: Stanley W. Granger, Diamond Bar, Calif.

[73] Assignee: NL Industries, Inc., New York, N.Y.

[21] Appl. No.: 922,859

[22] Filed: Oct. 24, 1986

[51] Int. Cl.[4] ..... E21B 33/06

[52] U.S. Cl. ..... 251/1.3; 251/1.1; 277/31

[58] Field of Search ..... 251/1.1, 1.2, 1.3; 277/30, 31

[56] References Cited

U.S. PATENT DOCUMENTS

| | | | |
|---|---|---|---|
| 4,332,367 | 6/1982 | Nelson | 251/1.3 |
| 4,447,038 | 5/1984 | Floyd | 251/1.3 X |
| 4,518,144 | 5/1985 | Vicic et al. | 251/1.3 |

*Primary Examiner*—A. Michael Chambers
*Assistant Examiner*—John C. Fox
*Attorney, Agent, or Firm*—Browning, Bushman, Zamecki & Anderson

[57] ABSTRACT

An improved blowout preventer of the ram type is provided with means allowing limited relative rotational movement of support elements in the seal along with radial inwardly directed movement of the ram assembly to conform to drill string size and accommodate for a tighter seal thereby enabling support of heavier drill string assemblies of smaller diameter pipe.

12 Claims, 4 Drawing Sheets

VARIABLE RAM SEAL FOR BLOWOUT PREVENTERS

BACKGROUND OF THE INVENTION

1. Field of the Invention

The present invention relates generally to blowout preventers forming a part of well drilling equipment and more particularly to a sealing element for a ram type blowout preventer whereby metal support elements in the seal are locked against outward movement thereby permitting support of greater weights of smaller diameter drill pipes.

2. The Prior Art

During drilling for oil and gas, instances occur when the drill string must be sealed to prevent damage to the well and the associated equipment. Various types of blowout preventer equipment have been used in the past to provide such a seal. For example, U.S. Pat. No. 3,736,982 discloses shear type and ram type blowout preventers; U.S. Pat. No. 3,667,721 discloses a spherical type blowout preventer; and U.S. Pat. No. 4,332,367 discloses a ram type blowout preventer having a variable ram seal that can be used with various sized pipes.

The present invention is intended for use with a ram type blowout preventer and enables the device to support greater weights of smaller diameter drill pipe than previously possible.

SUMMARY OF THE INVENTION

The present invention represents an improvement over the prior art by increasing the capability of a blowout preventer having a compressible assembly for handling heavier loads of smaller diameter pipe. The compressible seal assembly includes an arcuate portion comprised of a resilient, compressible material and including an inward radial projection to seal against the pipe and outwardly directed radial mounting end flange portions. Several rigid support elements are embedded in the arcuate portion to prevent rubber extrusion. These support elements are radially positioned around the arcuate portion and are circumferentially spaced from each other by a distance sufficient to accommodate compression of the arcuate portion to engage different size pipes but yet to support the arcuate portion. Each support element includes a pair of parallel support plates that are positioned on opposite sides of the arcuate portion with these plates being interconnected by an integral web embedded in the compressible material. Due to this arrangement, the resilient compressible material and the support element move radially inward upon the application of radial compression force to accommodate sealing around pipes of various sizes. A semicircular, profiled block supports the seal assembly in the blowout preventer and transmits the radial compressive force. One of either the support elements or the block are notched to permit the elements to rotate about the edge of the block locking the support elements with respect to the block to maintain sealing contact with the drill string.

BRIEF DESCRIPTION OF THE DRAWINGS

The present invention will now be described by way of example with reference to the accompanying drawings in which.

DETAILED DESCRIPTION OF THE PREFERRED EMBODIMENT

The present invention relates to a compressible, resilient ram type seal for use in a blowout preventer. The seal assembly of this invention is adapted for use with a variety of sizes of pipes and is particularly useful in accommodating heavy loads of small diameter pipe. In general, the invention includes a sealing assembly having an arcuate portion which has an inner radius of curvature corresponding to the largest pipe that can be sealed. The arcuate section, however, is capable of being radially compressed and portions thereof to rotate with respect to a ram block to assure proper sealing around smaller pipe sizes.

Figure 1:
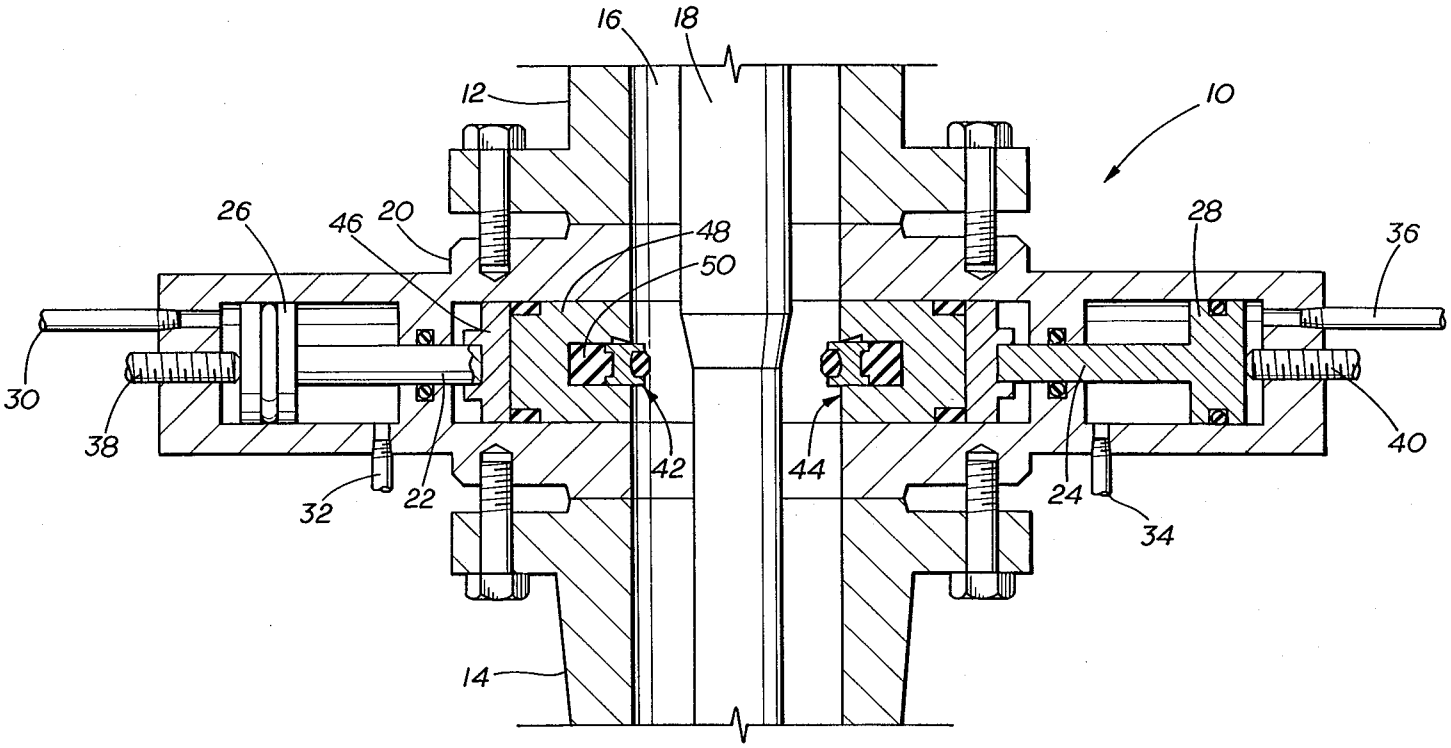
FIG. 1 is a vertical section through a blowout preventer incorporating the present invention.
Figure 2:
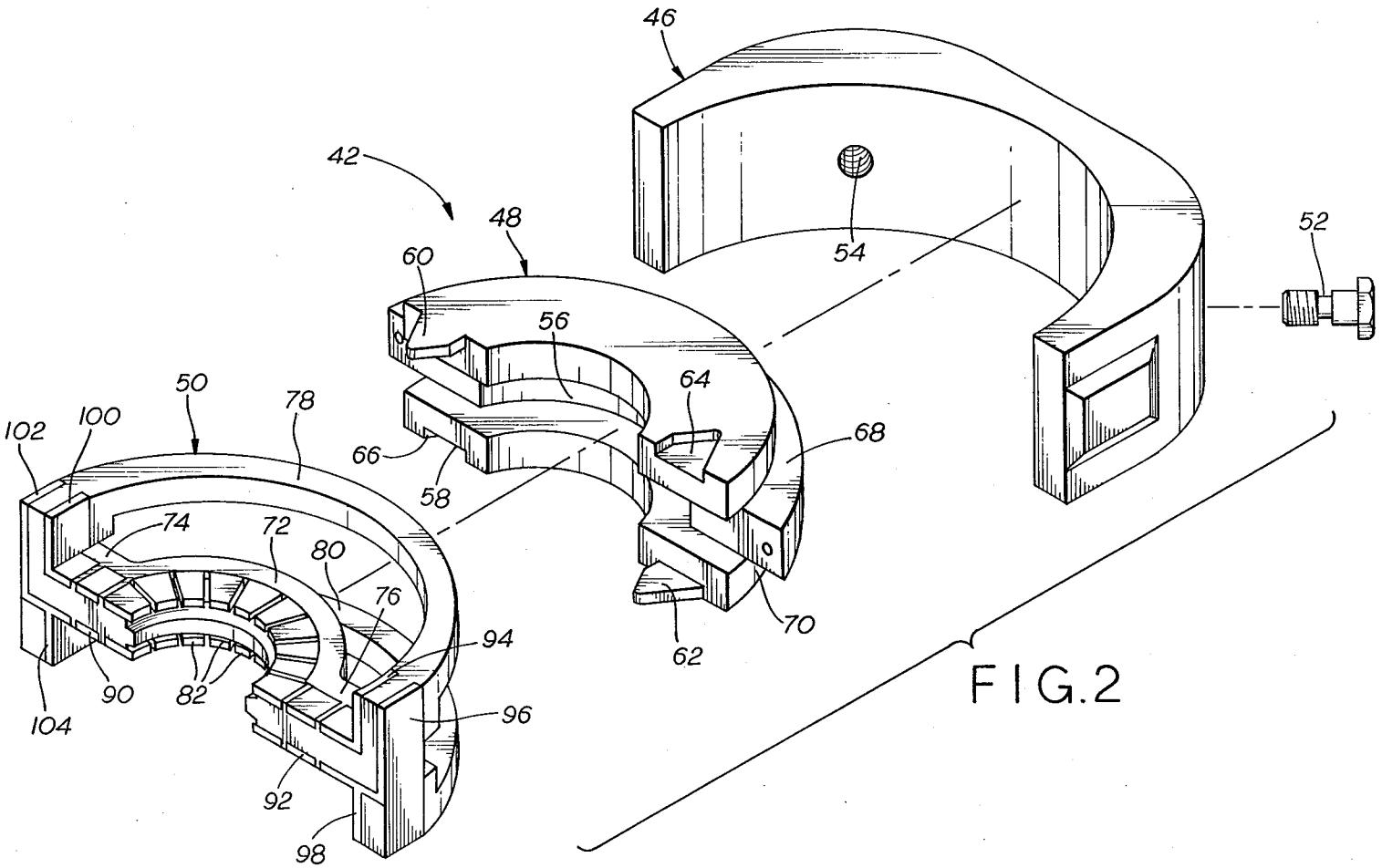
FIG. 2 is an exploded perspective view of a seal assembly, ram block and holder of a blowout preventer according to the present invention.

Turning now to FIG. 1, blowout preventer 10 is secured between casings 12, 14 and defines therewith an annular passage 16 for drill string 18. The blowout preventer 10 has a housing 20 with opposing rams 22, 24 mounted therein. The rams are driven by pistons 26, 28 which in turn are driven by pressurized fluid entering and exiting through conduits 30, 32, 34, 36, with the stroke of the pistons being limited by adjustable stop means 38, 40. Identical ram assemblies 42, 44 are responsive to the rams 22, 24 and seal the drill string 18. Each ram assembly 42 includes a holder 46, a ram block 48 and a seal 50. When assembled, the seal 50 seats in the block 48 and the seal 50 and the block 48 are retained in the holder 46. A ram assembly 42 will be described in greater detail with reference to FIG. 2.

The holder 46 is a generally C-shaped unitary member which receives the ram block 48 and seal 50 therein. One of a pair of retracting screws 52 is shown for fitting through a port 54 in the holder 46 to be threadedly received in a bore (not shown) in the ram block 48 in order to releasably secure the ram block 48 to the holder 46. The holder 46 preferably is comprised of a suitable steel material for transmitting forces from a ram 22, 24 to the seal 50.

The ram block 48 is a generally semiannular unitary member including an arcuate recess 56 in its forward or inner face 58 to receive a complementary shaped portion of the seal 50. Projections 60, 62 extend from the mating face of the block 48 to fit into complementary recesses 64, 66 on an opposing block (not shown in FIG. 2) for centering purposes. Outer arcuate recesses 68, 70 complete the profile. The ram block 48 is preferably one-piece casting of an alloy steel suitable for use in a drilling environment.

Figure 5:
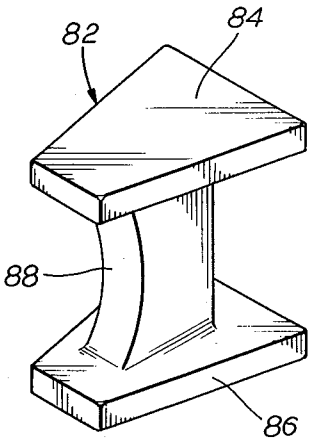
FIG. 5 is a perspective view of a support element embedded in the seal assembly of the first embodiment of the present invention.

The seal 50 has an arcuate generally semicircular central portion 72 and a pair of radially directed end flanges 74, 76 extending outwadly from the ends of the arcuate portion 72. Generally semicircular bands 78, 80 extend rearwardly from the respective sides of the end flanges 74, 76. The seal 50 is comprised of a compressible, resilient material, such as nitrile rubber. A plurality of support elements 82 are provided in the arcuate portion 72 of the seal 50. As best shown in FIG. 5, these elements 82 include a pair of parallel support plates 84, 86 interconnected by an integral web 88 which is embedded in and extends through the seal parallel to the axis of the arcuate portion 72. The support elements 82 are preferably made out of steel and the plates 84, 86 are preferably truncated or wedge-shaped to accommodate positioning in the arcuate portion of the seal. The plates 84, 86 of adjacent support element 82 are circumferentially spaced from each other by a distance sufficient to accommodate compression of the arcuate portion 72 when sealing smaller diameter pipes. Yet the support elements 82 are spaced closely enough to support the compressible material against extrusion during compression. Each flange section 74, 76 includes a plurality of support elements 90, 92 which are somewhat similar to the support elements 82 except for the configuration of the support plates, which are rectangular since they are on a linear rather than an arcuate portion of the seal. The seal is also provided with support elements 94, 96, 98, 100, 102, 104 embedded in the resilient material in the end region of each flange 74, 76. These support elements are provided for stability of the region adjacent the flanges, but these elements preferably are not included around the semicircular bands 78, 80.

Thus far, the present invention is similar to that described in the previously mentioned U.S. Pat. No. 4,332,367. However, it is at this point that the present invention distinguishes from the prior art. In the preferred embodiment shown in FIGS. 1–4, the ram block 48 is provided with an angled groove 106, an upper wall 108 of the recess 56. The location and size of the groove 106, with respect to the arcuate face of the ram block 48, are such as to accommodate rear portions of the upper plates 84 of the support elements 82.

Figure 4:
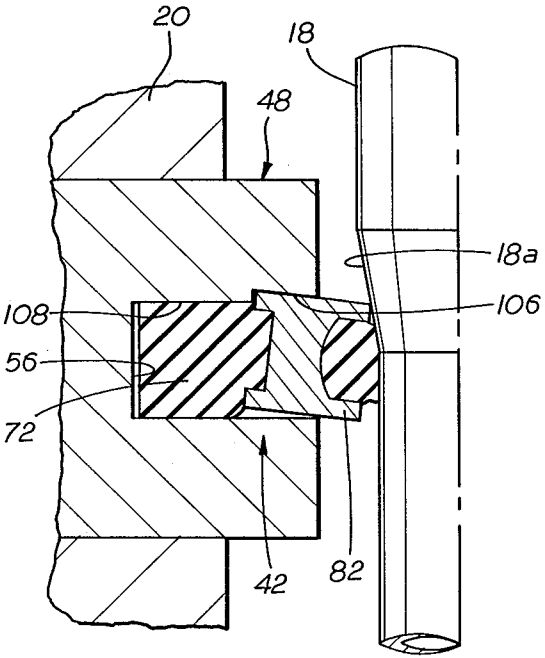
FIG. 4 is a detailed section similar to FIG. 3 showing the seal assembly, ram block and holder in a second sealed condition.
Figure 3:
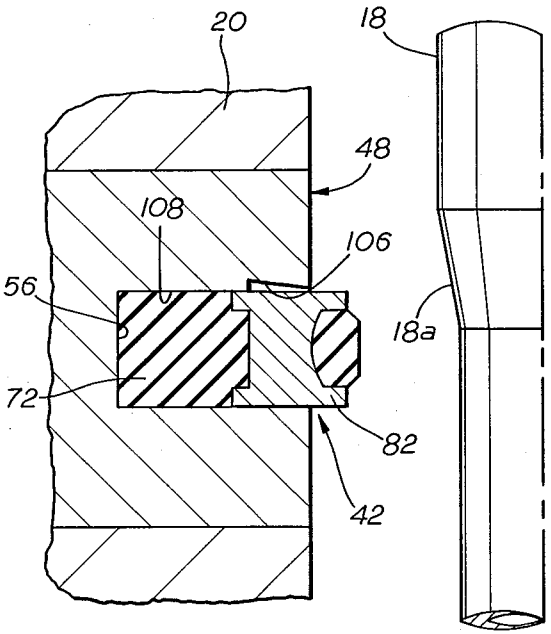
FIG. 3 is a detailed section of the seal assembly, ram block and holder in a first open condition.

The operation of the invention will be appreciated from FIGS. 3 and 4. In FIG. 3, the ram assembly 42 is shown in a retracted or open position relative to the drill string 18. In FIG. 4, the ram assembly 42 has been actuated to bring the seal 50 into contact with the drill string 18. In the previous ram-type blowout preventers, it may have been possible for a taper **18*a* in the drill string 18 to cause a camming or wedging action to drive the seal 50 back into recess 56 in the ram block 48 counter to the resistance of the seal material. Thus, there were definite limits as to the size and weight of the drill strings which could previousy be accommodated. In the present instance, the tapered portion 18*a* of the drill string 18 will cause the support elements 82 to rotate around the edge of the block 48, as shown in FIG. 4, to tightly seal the drill string 18 in the blowout preventer 10. When the support elements 82 are canted, as shown, then groove 106 prevents them from being driven into recess 56** and losing sealing relation with the drill string.

Figure 8:
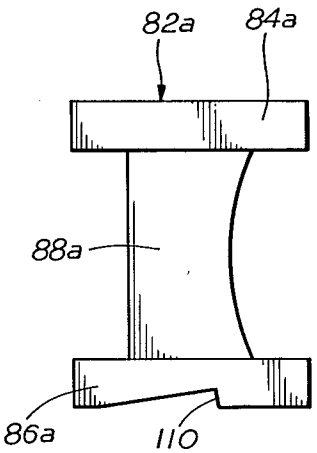
FIG. 8 is a side elevation of the alternate support element used in the embodiment of FIGS. 6 and 7.
Figure 7:
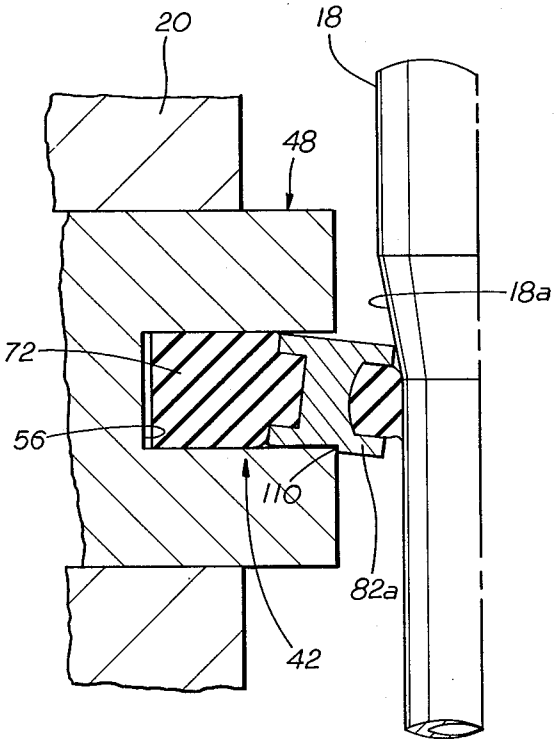
FIG. 7 is a detailed section, similar to FIG. 4, showing the alternate embodiment of the present invention in a second closed condition.
Figure 6:
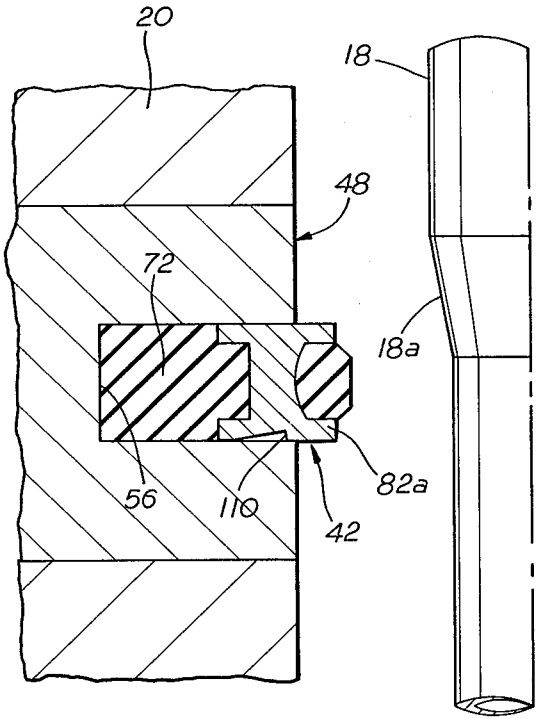
FIG. 6 is a detailed section, similar to FIG. 3, showing an alternate embodiment of the present invention in the first open condition.

The alternate embodiment of the present invention shown in FIGS. 6–8 differs from the preferred embodiment in that each bottom plate **86*a* of each support element 82*a* is provided with a tapered groove 110. It will be appreciated from FIGS. 6 and 7 that this groove 110 will likewise allow the relative rotational movement of the support elements 82*a* in ram block 48** to assure full support of the drill string.

The present invention prevents the metal support elements **82, 82*a* from sliding back into the recess 56 formed in the ram block 48 by means of the notches 106, 110 in either the segments 82*a* or the block 48** thereby permitting over 200,000 pounds of smaller size drill pipe to be suspended from the blowout preventer. The previously known designs would suspend less than 10% of this weight.

When the ram assembly 42, 44 is closed about a pipe or tube where the drill collar outer diameter is smaller than the inner diameter of the seal 50, and the weight of the drill string is lowered onto the seal with the support elements 82 in a hangoff situation, the elements of the present invention are rotated to tilt downwardly. In the first embodiment, the groove 106 in the block 48 is just inboard of the rear of the plates 82. In the alternate embodiment, notch 110 on the plate **86*a* is located such that, in the closed condition, it overlies the edge of the block. As the weight of the string is lowered onto the support elements, the support elements rotate such that the back of the plates 82 raises up into the groove 106 in the block 48 (or the notch 110 grips over the inner edge of the block 48 in FIGS. 7 and 8) thereby preventing the support element 82 from traveling radially back away from the bore and releasing the drill string. When the weight of the string is removed, the attached rubber of the seal 50** returns the support elements to their original positions allowing the support elements to retract back into the rubber pocket when the rams are open.

The foregoing disclosure and description of the invention is illustrative and explanatory thereof, and various changes in the size, shape and materials as well as in the details of the illustrated construction may be made within the scope of the appended claims without departing from the spirit of the invention.

What is claimed is:

1. A blowout preventer, comprising:

a body member including a bore for the reception of a drill string and having a plurality of ram chambers in a plane perpendicular to the well bore;

a ram assembly in each of the ram chambers, each ram assembly including a holder, a ram block releasably secured to the holder, and a compressible ram seal carried by the ram block, the holder, block and seal being movable as a unit in a respective chamber perpendicular to the well bore, the seal being capable of use with a variety of pipe sizes and including:

a semicircular portion comprised of a resilient, compressible material defining an inwardly directed radial projection to seal against a pipe, a plurality of rigid support elements each of which includes a pair of parallel support plates that are positioned on opposed sides of the semicircular portion and that are interconnected by an integral web embedded in the compressible material, one of said ram block or a plate of each said support elements having an inclined groove therein directed toward the other of said ram block or plate allowing said support elements to rotate about an edge of the block to a locked position sealingly engaging a drill string while being prevented from withdrawing into the block against said compressible material.

2. A blowout preventer according to claim 1 wherein said inclined groove is in an upper wall of said block positioned to receive therein a rear portion of the plates, said support elements rotating about an inner edge of said block.

3. A blowout preventer according to claim 1 wherein said inclined groove is in a lower plate of each said support element, said grooves aligned with an inner edge of said block which is received therein during tilting of the support elements.

4. For use in a blowout preventer, a compressible seal element capable of use with a variety of pipe sizes, comprising:

a semicircular portion comprised of a resilient, compressible material and including an inward radial projection to seal against a pipe, a plurality of rigid support elements each of which includes a pair of parallel spaced support plates that are positioned on opposed sides of the semicircular section and that are interconnected by an integral web embedded in a compressible material, an inclined groove in one plate of each of said support elements aligned with respect to an edge of a block receiving said seal whereby said support elements are able to tilt under a load thereby maintaining sealing engagement without being driven back into the block against the force of the compressible material.

5. The invention as defined in claim 4 wherein the parallel support plates of the rigid support elements in the semicircular portion of the seal are truncated, wedge-shaped sections whose similar dimension is directed radially inwardly.

6. A seal and block assembly for use in a blowout preventer comprising:

a generally semiannular block member of incompressible material including a first recess around its inner periphery intermediate the edges thereof to define a generally semicircular seal receiving ledge; and a seal element including a semicircular central portion and an outwardly directed radial flange portion at each end of the semicircular portion, the semicircular portion and the radial flange portion being comprised of a resilient, compressible material; at least the semicircular portion including a plurality of rigid support elements each having a pair of spaced parallel plates that are positioned on opposed sides of the semicircular portion and that are interconnected by an integral web embedded in the compressible material, one of said block or each plate on one side of said support elements having an inclined groove allowing relative rotation of said support elements about an edge of said block.

7. A seal and block assembly according to claim 6 wherein said inclined groove is in an upper wall of said block positioned to receive a rear edge of upper plates of said support elements as they rotate about an inner edge of said block to a tilted sealing position.

8. A seal and block assembly according to claim 6 wherein a said inclined groove is in a lower plate of each said support element aligned with an inner edge of said block which is received in said groove to allow rotational tilting of said support elements to assure sealing with small diameter pipes.

9. A seal and block assembly according to claim 6 wherein said seal and block assembly is used in opposing pairs of assemblies.

10. A seal and block assembly for use in a blowout preventer, comprising:

a block member of substantially incompressible material for retaining and supporting the seal in the blowout preventer, the block being generally semiannular and including a first seal receiving and supporting recess in its inner surface;

a seal having at least a semicircular central portion comprised of a resilient, compressible material having therein a plurality of rigid support elements, which are radially positioned and circumferentially spaced from each other, each support element including a pair of spaced plates that are positioned on oposed sides of the semicircular seal section and that are interconnected by an integral web embedded in the compressible material; and means permitting tilting of said support elements with respect to said block whereby said seal maintains tight engagement with pipes of a drill string.

11. A seal and block assembly according to claim 10 wherein said means comprises:

an inclined groove in an upper wall of said block spaced to receive rear portions of upper plates of said support elements thereby allowing relative rotation to said tilted position.

12. A seal and block assembly according to claim 10 wherein said means comprises:

an inclined groove in each lower plate of each said support element, said groove aligned with an edge of said lock allowing relative movement for engagement of said edge in said groove and subsequent relative rotation to said tilted position.

* * * * *

UNITED STATES PATENT AND TRADEMARK OFFICE

CERTIFICATE OF CORRECTION

PATENT NO. : 4,770,387

DATED : September 13, 1988

INVENTOR(S) : Stanley W. Granger

It is certified that error appears in the above-identified patent and that said Letters Patent is hereby corrected as shown below:

In Column 5, line 29, delete "similar" and insert therefor --smaller--.

In Column 6, line 30, delete "oposed" and insert therefor --opposed--.

In Column 6, line 46, delete "lock" and insert therefor --block--.

Signed and Sealed this

Twenty-fourth Day of January, 1989

*Attest:*

DONALD J. QUIGG

*Attesting Officer*

*Commissioner of Patents and Trademarks*